US009510418B2

(12) United States Patent
Bhagwat et al.

(10) Patent No.: US 9,510,418 B2
(45) Date of Patent: Nov. 29, 2016

(54) LIGHT EMITTING DIODE (LED) DIMMER CIRCUIT AND DIMMING METHOD FOR LEDS

(71) Applicant: XSI Semiconductors Private Ltd., Bangalore, Karnataka (IN)

(72) Inventors: Hrishikesh Bhagwat, Bangalore (IN); Krishnadas Bhagwat, Bangalore (IN); Rajesh Swaminathan, Bangalore (IN); Somnath Samantha, Bangalore (IN); Abhisek Khare, Bangalore (IN)

(73) Assignee: XSI Semiconductors Private Ltd. (IN)

( * ) Notice: Subject to any disclaimer, the term of this patent is extended or adjusted under 35 U.S.C. 154(b) by 0 days.

(21) Appl. No.: 15/024,633

(22) PCT Filed: Jun. 13, 2014

(86) PCT No.: PCT/IB2014/062216

§ 371 (c)(1),
(2) Date: Mar. 25, 2016

(87) PCT Pub. No.: WO2015/044798

PCT Pub. Date: Apr. 2, 2015

(65) Prior Publication Data

US 2016/0242253 A1 Aug. 18, 2016

(30) Foreign Application Priority Data

Sep. 27, 2013 (IN) ..... 4409/CHE/2013

(51) Int. Cl.
*H05B 33/08* (2006.01)

(52) U.S. Cl.
CPC ..... *H05B 33/0854* (2013.01); *H05B 33/0815* (2013.01); *H05B 33/0821* (2013.01); *H05B 33/0845* (2013.01)

(58) Field of Classification Search
CPC ..... H05B 33/08; H05B 33/0815; H05B 33/0845; H05B 33/0833; H05B 33/0839; H05B 33/0851; H05B 332/0818; H05B 33/0827
USPC ..... 315/210, 247, 250, 291, 294, 297, 307, 315/308, 312
See application file for complete search history.

(56) References Cited

U.S. PATENT DOCUMENTS

| | | | | |
|---|---|---|---|---|
| 8,026,676 | B2 * | 9/2011 | Liu | H05B 33/0848 315/291 |
| 8,258,714 | B2 * | 9/2012 | Liu | H05B 33/0818 315/210 |
| 2014/0203733 | A1 * | 7/2014 | Stepps | H05B 33/0845 315/307 |

FOREIGN PATENT DOCUMENTS

| | | |
|---|---|---|
| CN | 101820711 | 9/2010 |
| CN | 101909386 | 12/2010 |
| CN | 102036437 | 4/2011 |
| CN | 102695330 | 9/2012 |

* cited by examiner

*Primary Examiner* — Thai Pham
(74) *Attorney, Agent, or Firm* — Robert Plotkin, P.C.; Robert Plotkin

(57) ABSTRACT

A dimmer circuit (100) and a dimming method for an event based integrated driver system for a light emitting diode lighting application is disclosed. Dimmer circuit (100) includes a front end module for receiving an external dimming input in an analog domain, a digital domain or software domain and for operating a dimming output; an event generator for generating a plurality of events in a prioritized manner to trigger a respective response through front end module; and a firmware module configured for storing instructions for processing the plurality of events in the prioritized manner and for processing each response to implement a functionality in dimming output, where front end module, event generator and firmware module communicate with each other to generate dimming output of the one or more LEDs, and the dimming output has at least one of a linear profile, a non linear profile, a custom profile or combinations thereof.

30 Claims, 9 Drawing Sheets

100

100

300

600

700

LIGHT EMITTING DIODE (LED) DIMMER CIRCUIT AND DIMMING METHOD FOR LEDS

This application takes priority from the Provisional application 4409/CHE/2013 filed with the Indian Patent Office on 27 Sep. 2013.

FIELD OF THE INVENTION AND USE OF INVENTION

The invention relates generally to light emitting diodes (LED) and more specifically to a dimmer circuit incorporated in a driver system for LEDs and associated dimming methods, useful in achieving flicker free dimming without compromising linearity and resolution of the LED lighting.

PRIOR ART AND PROBLEM TO BE SOLVED

LEDs are used in a variety of applications as indicator lamps and in different types of lighting environments, for example in aviation lighting, digital microscopes, automotive lighting, backlighting, advertising, general lighting, and traffic signals. Customized lighting solutions using LEDs are also being desired by the consumers.

Typically, the LED driver circuit is incorporated in an IC (referred herein as driver IC) and is a constant current source that drives the LEDs to provide constant illumination. However, new lighting applications require a dimming feature to be incorporated into the LED lighting solution. LED systems have their own requirements and limitations such as LED lighting is susceptible to flicker, thermal runaway issues and various fault scenarios and requires more precise current and heat management.

One of the ways to incorporate dimming in current LEDs is through a Pulse Width Modulation (PWM) scheme. In a typical PWM dimming scheme, the ratio of current On time to Off time is modulated and this controls the total light intensity. In deep dimming regime that is when the LED On time is very short, typically >1:1000 i.e. the ratio of On time to Off time is in the order of 1 to 1000, the resulting light intensity is very low and results in deep black color. The quality i.e. the degree of black color is a measure of color merit (contrast) and is highly desired. In such deep dimming regime following challenges are present:

a. Any minimal change in intensity is easily perceived by eye b. A quick (step) change in intensity appears as a flash c. A noise in external dimming signal manifests as rapid change in light intensity and appears as flicker d. To overcome this noisy external signal, certain system filtering techniques & components are implemented to eliminate the noise. However this results in added system cost &/or loss in resolution e. There is a loss of linearity in average currents at deep dimming ratios Due to these challenges, it is very difficult to achieve smooth, no resolution loss and linear dimming using the current dimming techniques and circuits.

It may be noted here that the flicker and loss of resolution issues for light output through analog dimming is lesser than PWM dimming, as analog dimming typically do not push to high dimming ratios. Nonetheless, noise on analog dimming signal has a bearing on quality of output light.

It may further be noted that the deep dimming performance is affected both by fundamental control loop and as well the quality of external dimming signal. The ideal high dimming ratios for a fixed frequency power converter is governed by the ratio of power converter switching frequency (Fsw) to PWM dimming frequency, as stated below:

a. If Fsw=1 MHz and PWM dimming frequency is 100 Hz, then the highest possible dimming ratio without loss of linearity is i. Fsw:$F_{PWM}$=1 MHz:100 Hz=10000:1 b. If the ratio needs to be increased then either Fsw should increase or PWM dimming frequency decrease. Both these approaches have certain limitations due to real world system complexity.

To prevent LED thermal runaway during dimming, a typical external temperature sensing element, such as NTC resistor, is placed near LEDs to relay the increase in LED temperature to the driver IC. The driver IC reduces the LED currents to reduce LED temperature and subsequently restore the original LED currents when temperature drops below to stated safe operating regime. This operation results in further challenges as listed below:

a. The throttling of LED currents back and forth can appear as a sudden drop in light intensity or a flash.

b. Throttling of LED currents by modulating the peak currents, (i.e.) Analog dimming, results in shift in color compensation.

It would be appreciated that in high performance back lighting applications, the color quality of light (maintain an accurate white point) across the LED temperature is desired to be constant, (i.e.) color point (white point) should not vary with LED temperature. Typically in prior art methods, two or more light sources are operated together and the intensity of one or more sources is modulated in a pre determined (programmed/calculated) manner with respect to LED temperature to regain the constant color (white point) set point. This is difficult to achieve without external components, and is not easy for implementation.

On the other hand, in high CRI (color rendering Index), CCT (correlated color Temperature) scheme, the light color is intentionally changed with respect to light intensity which correlates with the temperature of the light source. For example, in incandescent light sources at lower dimming levels, the tungsten filament cools down (as it is resistive in nature) giving a reddish hue to light and at higher light intensity levels the color moves towards warm yellow in appearance. When the incandescent sources are replaced by LED sources this color dependency on the light intensity is lost. In LED lighting applications that require an incandescent type color feel, it is a challenge to modulate light color with light intensity or temperature.

Further, in deep dimming, there is a challenge to distinguish start up and fault conditions such as output short. To achieve high dimming ratios and linearity, the charge in the output capacitor (capacitor that supplies the LED) is preserved during PWM Off time. Typically, this is achieved by disconnecting the output cap from the discharging path. One of the issues with respect to above approach is the occurrence of output voltage spike when the output discharge path is cut off (PWM ON to OFF transition). Since the inductor has the energy and when the discharge path is cut off, the stored inductor energy will be dumped to output cap resulting in output voltage spike.

The above energy dump from PWM ON to OFF transition is severe when the system is operated at high power levels (i.e.) higher the energy on the inductor, higher the output spike. Such an output spike can cause reliability issues due to higher voltage stress on the external components and as well the chip, the driver IC (during the next PWM Off to On transition).

OBJECTS OF THE INVENTION

Thus the LED environment poses specific challenges for the dimming technique and for the circuit within the LED driver system. There is a therefore a need for a new analog-digital-firmware dimming solution that achieves flicker free dimming without compromising linearity and resolution of the LED lighting and achieving programmable dimming profiles that addresses the challenges related to high performance back lighting applications, high CRI (color rendering Index), CCT (correlated color Temperature) scheme, and distinguishing between start up and fault conditions.

SUMMARY OF THE INVENTION

In one aspect of the invention a dimming method and a dimmer circuit for LED lighting, to obtain flicker free dimming without compromising linearity and resolution, and for obtaining any desired dimming profile is presented. The dimmer circuit includes an appropriate front end module that can be either an analog module, a digital module, a software module based on the lighting application. The dimmer circuit includes a firmware module, that interacts with the analog module, a digital module, a software module via an event generator. The analog module, the digital module and the software module generate one or more events that corresponds to an external dimming input, through the event based module, and a response to process the one or more events (either in analog, digital or software domain) is determined by the firmware module. The LED dimmer circuit of the invention is configured thus to operate in a flexible manner in analog, digital and software domains to achieve high dimming ratios without loss of linearity. The dimming method eliminates the need and requirements of noiseless external dimming signal and at the same time achieves high resolution and linearity. The dimming method is used to achieve excellent linearity, no resolution loss, smooth dimming performance at deep dimming levels. The smooth PWM dimming and programmable (temperature) compensated dimming profile preserves the color point across varying LED temperature applications. The dimming method and architecture also allows modulation of light color with respect to intensity of light. The dimming method also solves the output voltage spike during PWM ON to OFF transition in PWM dimming systems.

In one implementation the method for obtaining a desired dimming profile for LED lighting application is disclosed. The method includes steps for receiving an external dimming input through a front end module (analog module, digital module or software module) and storing a plurality of parameters corresponding to the external dimming input in a configuration register. The method then includes a step for triggering one or more events corresponding to stored parameters. Next these one or more events are processed in a prioritized manner based on pre-defined instructions in a firmware module to obtain the processed event, wherein the pre-defined instructions correspond the desired dimming profile. It may be noted here that the processing is done in analog domain, digital domain or software domain based on the predefined instructions. The method then includes the step for generating a dimming output based on the processed event, wherein the dimming output has the desired dimming profile.

BRIEF DESCRIPTION OF THE DRAWINGS

These and other features, aspects, and advantages of the present invention will become better understood when the following detailed description is read with reference to the accompanying drawings in which like reference numerals represent corresponding parts throughout the drawings, wherein.

DETAILED DESCRIPTION OF THE INVENTION

As used herein and in the claims, the singular forms "a," "an," and "the" include the plural reference unless the context clearly indicates otherwise.

As used herein, the term "LED" means light emitting diodes which is a semiconductor light source capable of emitting different colored light intensity such as but not limited to red, visible, ultraviolet, infra-red wavelengths.

As used herein, the term "LED circuit" or "LED driver system" is an electric power circuit used for powering an LED.

As used herein, the term "LED dimmer circuit" or "dimmer circuit" is an electric power circuit used for dimming operation for an LED. In specific implementation the LED driver system and LED dimmer circuit are integrated into one circuitry.

As used herein, the term "firmware" means embedded software and computer programs and instructions or code, memory and data stored in it. Specifically in relation to the invention firmware has control and operating instructions for all events.

Figure 1:
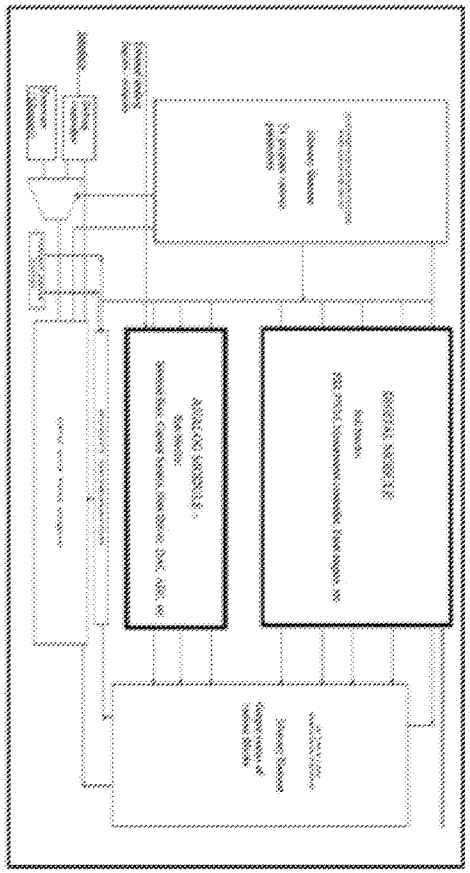
FIG. 1 is a diagrammatic representation of an LED driver system functioning as the LED dimmer circuit according to one embodiment of the invention.

FIG. 1 is a diagrammatic representation of an LED dimmer system according to one embodiment of the invention. The system includes a front end module (only configuration register of the front end module is shown for clarity purpose) that can be an analog module, a digital module, a software module, depending on what type of external dimming input needs to be fed to the dimmer circuit. The front end analog module or the digital module or the software module generate one or more events due to an external dimming input. The external dimming input may be received from a software in one example, and through hardware in another example. The external dimming input may be in analog domain, digital domain or software domain. When the external dimming input is in analog domain, it is received by the analog module and when the external dimming input is in digital domain it is received by the digital module. When the external dimming input is in software domain, it is received by the software module. Once the external dimming input is received by front end analog module or the digital module, or the software module, an event is generated in the event module and corresponding parameters are stored in a configuration register of the front end module.

The dimmer circuit further includes a firmware module that interacts with the front end module via an event generator (also referred as event based module). The events are generated in response to the parameters in configuration register and are processed (either analog, digital or software module) based on the instructions from the firmware module. For example, as a response to an event generated on receiving an external dimming input, the digital module that has the PWM engine and other digital functional components is triggered to process the said event. These events have priority and the firmware module responds accordingly. Such an LED driver system is an event based integrated driver system that operates as a dimmer circuit according to one aspect of the invention for a light emitting diode (LED) based lighting application.

The dimmer circuit thus includes an analog module, a digital module, a software module configured for receiving an external dimming input and for operating a dimming output, where the external dimming input and the dimming output is in analog domain for the analog module, and the external dimming input and the dimming output is in digital domain for the digital module, and the external dimming input is through a special function software that is implemented as a code or through special hardware. The event generator is used for generating an event corresponding to the external dimming input and is agnostic to analog and digital domain. A firmware module is configured for storing instructions for processing the events in a prioritized manner and trigger a response for each event for implementing a functionality in the dimming output by the digital module. It may be noted here that the analog dimming input can be initially processed in analog domain and subsequently converted to digital domain. Similarly in certain application cases the external digital input can be initially processed in digital domain and subsequently internally converted to analog domain for ease of implementation. Thus the dimming output information can be switched between analog &/or digital domains to suit the application. The firmware controls the sequence of events as to which domain dimming signal needs to traverse to achieve final dimming output.

It would be understood by those skilled in the art that the analog module, the digital module, the software module, communicate with the event generator and the firmware module using standard communication protocols to generate the dimming output. It would be further appreciated by those skilled in the art that the event based and firmware controlled dimming output allows for generating different profiles for the output according to the particular lighting application requirements. For example, the dimming output has at least one of a linear profile, a non linear profile, a custom profile or combinations thereof.

The different modules and their components that are shown in the exemplary schematic of a LED dimmer circuit 100 in FIG. 1, and are described herein below.

Configuration Register: This is a configuration memory element in which various parameter values are stored. Some of the examples for parameters are LED current level, over temperature set point, over voltage level set point and so on. These values can be configured through an external user interface using a front end module.

Status Register: This is a status memory element in which output status of various sub modules such as analog, digital, software, firmware ware are stored.

Digital Module: includes components configured to perform digital functions. Some of the exemplary digital components are:

PID Engine—configured for closed loop compensation control

PWM Engine—configured for calculating PWM duty cycle for dimming purpose

Fault Engine—configured for calculating digital fault bands and threshold

Multiplier unit—configured for mathematical computations

Analog Module: includes components configured to process analog signals. Some of the examples are:

Internal Bias engine—configured for generating internal voltage supplies, references Current source engine—configured for defining and regulating a constant current Gate Drive unit—configured for providing drive for power Gate stage DAC—Digital to Analog Converter ADC—Analog to Digital Converter Temp Sensor—configured for sensing temperature Event Generator (referred herein sometimes as event based module)—As explained hereinabove, an event is an outcome of a hardware functionality or a programmed functionality that is implemented as computer readable instructions on a computer readable medium. Each event has a certain priority and event generator resolves which code block in CPU should be executed based on incoming events, the configuration and the priority.

CPU—Central Processing unit—The CPU is the brain of the system and executes the code block in accordance with the event. This also configures various hardware blocks and performs basic computation.

Firmware module—This is the code or computer readable instructions (software) written to control a functionality. CPU operates on the firmware as defined by the event generator. The firmware is stored in an internal memory element. The firmware can also reside external to chip and can be transmitted through an interface.

Heart beat timer—configured to ensure event generator is alive if in absence of any internal event as defined by status register.

Debug controller (Software module)—configured to assist in debugging the integrated chip. A special debug code can be transmitted through debug controller. The debug controller can directly control CPU if required.

External Analog Inputs—Analog input signals from outside the chip. These signals directly interact with analog module.

Interface—This is used to transmit digital input/outputs. Some of the examples as would be understood to those skilled in the art are I2C interface, SPI, UART, two wire, Dali etc. The firmware module can be programmed through the interface. The interface can be used to ascertain the condition of the driver system, for example in the embodiment of the LED dimmer circuit, parameters such as LED currents, and the fault warnings of the LED driver IC can be communicated to outside world.

Figure 2:
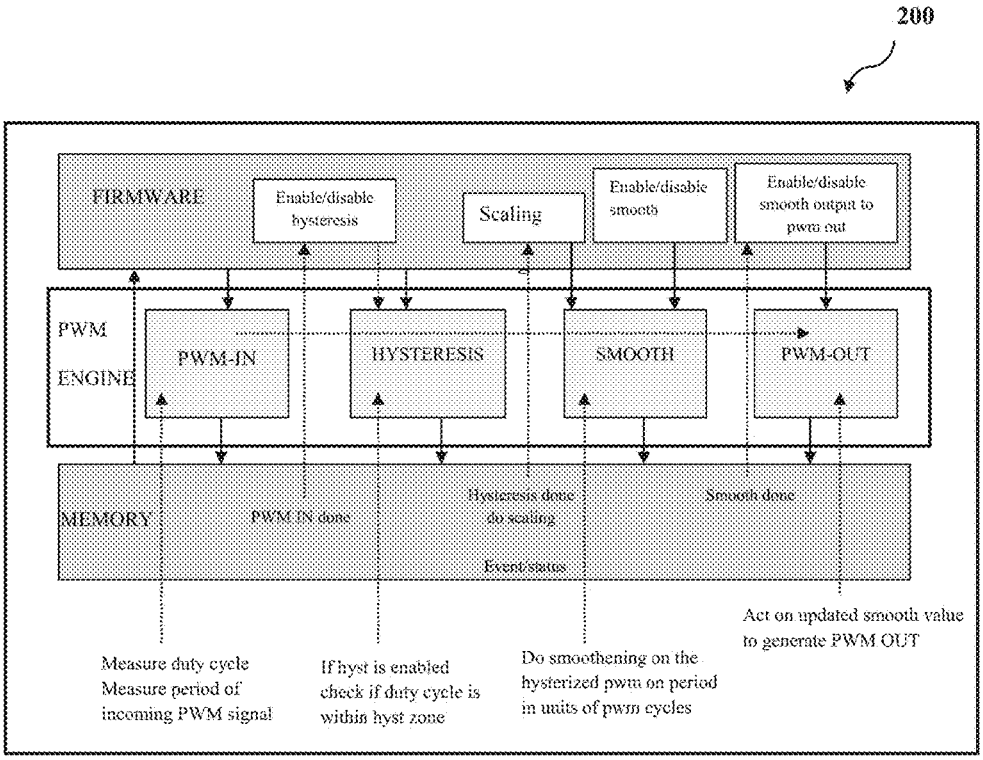
FIG. 2 is a diagrammatic representation of the flow of sequence of events and responses for generating a dimming output from the LED dimmer circuit of FIG. 1.

FIG. 2 explains the flow of steps in the representation 200 for generating the desired dimming output. The digital module as described herein has several digital functional components for different functionalities for the dimming output. A PWM engine is provided in the digital module that includes a Phase Frequency Detector to detect a Phase (Duty cycle) and a frequency of the external dimming input. The PWM engine also includes a Hysteresis component to filter noise on the external dimming input (i.e.) improve noise immunity of the output dimming signal. A Smoothening component is provided to control the rate of change of duty cycle for the dimming output. A PWM OUT component to generate the duty cycle and frequency of the dimming output as an event, and then a corresponding dimming output is generated. It would be appreciated by those skilled in the art that other such desired functional components may be added in the digital module (and similarly in the analog module) to implement the functionalities as per the desired dimming output from the dimmer circuit.

Referring back to FIG. 2, the event is generated on receipt of the external dimming input and is stored in the memory of the event generator. A response to generate a PWM-IN event is then generated by the event generator that is controlled through the firmware module. The functional component, the Phase Frequency Detector of the digital module receives this event and process it according to the instructions from the firmware module. Once this response is completed it is stored in the memory of the event generator as "PWM-IN done". Next event is generated to check if enable/disable hysteresis requirement is there, which triggers the hysteresis component to check if hysteresis is enabled, then if the duty cycle determined in the previous step is in hysteresis zone, if it is not a response is generated to change the duty cycle to be in the hysteresis zone. Subsequently, completion of this response is stored in the memory component of the vent generator as "hysteresis done". The next event to check for smoothening of the output from the hysteresis component is generated and corresponding action/response based on the instruction from the firmware module is accomplished and the corresponding completion event is stored in the memory of the event generator. Finally to generate the dimming output, dimming action is applied on the output from the smoothening component as shown in the representation 200 of FIG. 2. The firmware module may involve hardware blocks and software blocks to produce desired dimming output through series of prioritized events. It may be appreciated that only few exemplary digital functional components, exemplary instructions in the firmware module and the event and responses are shown in FIG. 2 by way of example to enable understanding for implementing the dimmer circuit of the invention. Using the same approach any desired functionality in analog or digital domain or partly in analog and partly in digital domain may be implemented.

The final dimming output (PWM DC) is therefore a function of both software block and hardware block responses as provided in the firmware module. More details of some exemplary functionalities and functional blocks are described in more detail herein below.

The hysteresis component is configured to provide a programmable hysteresis window limit for PWM Duty Cycle (PWM-DC) change through the instructions (referred generally as firmware) from the firmware module for filtering out the external noise in the dimming signal (external dimming input). This firmware defined limits is passed onto dedicated hysteresis block to process (eliminate noise) signals accordingly as discussed herein above. Thus any noise within the hysteresis window is ignored by the LED dimmer circuit thus eliminating the light flicker due to such external noise in the dimming signal. In an exemplary implementation, the frequency of the external dimming input is converted into an internal PWM signal while preserving a duty cycle information of the external dimming input or by modifying external duty cycle information in a desired (programmable) manner using the firmware module, The programmable hysteresis window along with smoothening component as described herein allows a smooth change in PWM-DC by converting the external dimming input Duty cycle change to the PWM output Duty Cycle change. It would be understood by one skilled in the art that in a typical hysteresis window approach used conventionally in prior art systems, a discrete step increase is made in the PWM-DC, and this step increase appears as a flash sometimes, sometimes as loss in linearity or both. To overcome this issue, the dimming method presented in the invention and implemented through the dimmer circuit allows smooth increase in PWM-DC as explained herein below.

a. Assume Current PWM DC=10 counts; Hysteresis=4 counts.

b. based on above assumption the LED dimmer circuit will not change PWM-DC when external signal is between 7 and 13.

c. When PWM-DC changes to 14, then system gradually changes from 10 to 14.

Figure 3:
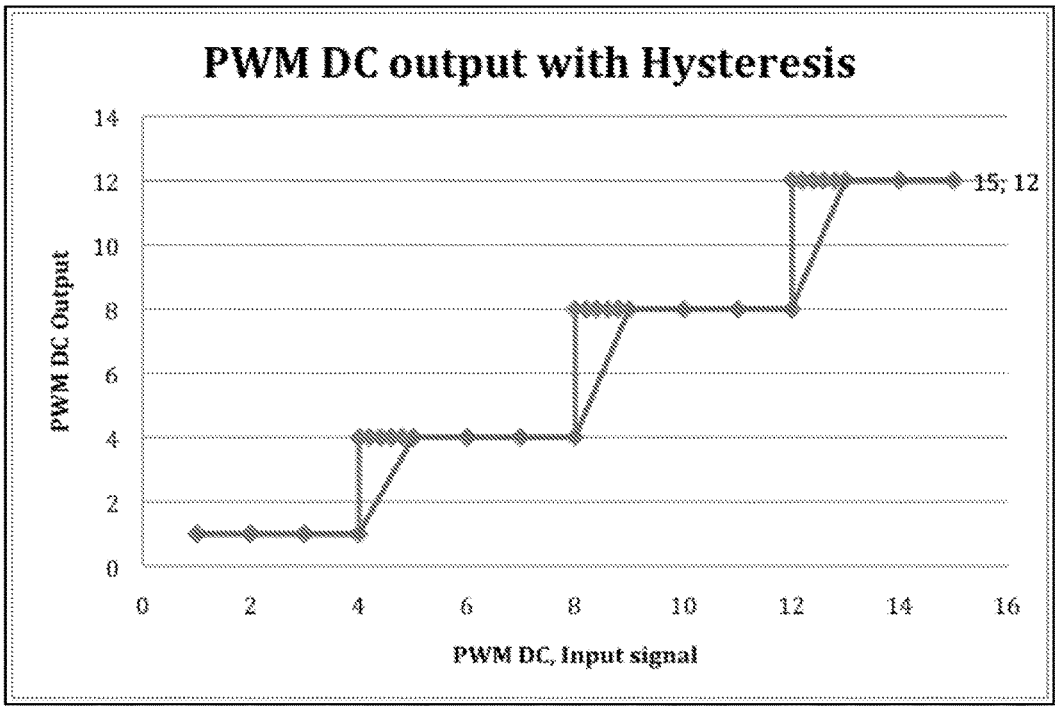
FIG. 3 is a waveform representation of the smooth change in the dimming output using s hysteresis component in the dimmer circuit of the invention.
Figure 4:
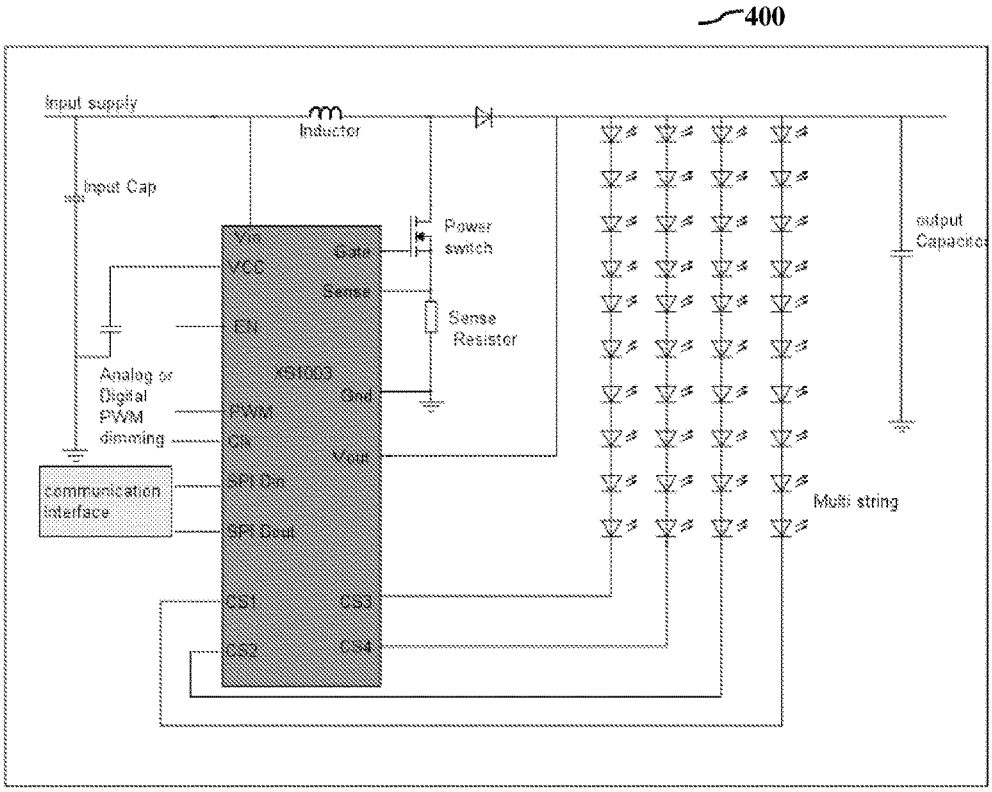
FIG. 4 is an exemplary implementation of the dimmer circuit for a multi string operation.

This smooth change eliminates the discrete step change effects and flash issues in conventional dimming. In addition the hysteresis window and rate of change form one PWM-DC to next level is programmable i.e. configurable giving higher system flexibility. This smooth change is depicted through the waveform representation 300 of FIG. 3. Further, in this circuit and dimming method, no additional external components or processing is required on the external dimming signal. As mentioned herein above that the external dimming input is converted to internal PWM modulation scheme. Once in the PWM dimming regime, the dimming method implemented through the dimmer circuit, eliminates flicker, flash and loss of linearity as described above. Hence the dimming signals (external analog dimming input) need not have high noise immunity constraints and associated external components, making the implementation simple and economical. An exemplary implementation 400 of the dimmer circuit of the invention is shown in FIG. 4.

TABLE 1

| Input | Step change | Smooth change |
|---|---|---|
| 1 | 1 | 1 |
| 2 | 1 | 1 |
| 3 | 1 | 1 |
| 4 | 1 | 1 |
| 4.2 | 4 | 1.6 |
| 4.4 | 4 | 2.2 |
| 4.6 | 4 | 2.8 |
| 4.8 | 4 | 3.4 |
| 5 | 4 | 4 |
| 6 | 4 | 4 |
| 7 | 4 | 4 |
| 8 | 4 | 4 |
| 8 | 8 | 4 |
| 8.2 | 8 | 4.8 |
| 8.4 | 8 | 5.6 |
| 8.6 | 8 | 6.4 |
| 8.8 | 8 | 7.2 |
| 9 | 8 | 8 |
| 9 | 8 | 8 |

Table 1 above indicates as an example how the hysteresis window is used for smoothening the output signal. The values shown herein are hypothetical, and only meant to explain the working principle as described herein.

In the lighting solutions that require ultra deep dimming (i.e.) going beyond Fsw (frequency of external analog dimming input): PWM limitations on dimming, the dimming circuit is configured to operate in pulse skipping mode in one exemplary embodiment to achieve ultra high dimming ratios. For example, when Fsw=1 Mhz, PWM=100 Hz, the ideal max PWM dimming=10000:1. To achieve say 20000:1, the power converter will go in pulse skipping mode.

Further in the above exemplary embodiment, the LED continues to operate at PWM DC of 100 Hz, however the power converter operates in hysteretic mode when PWM ON time is below a certain specified value. Thus the power converter may be ON even after PWM goes high to low (i.e. when PWM goes high and if the feedback error signal is beyond a minimum specified value), the power converter will start switching and stay ON until determined by control loop hysteresis window. During a subsequent PWM ON time, the power converter may or may not be ON as determined by the PWM hysteresis window. Thus, this method implemented through the dimmer circuit decouples power converter switching frequency limitations imposed on minimum dimming ON time.

The above approach ensures, that LED light is operated at 100 Hz (10 ms) and hence no flicker is observed (eye can perceive changes below 60 Hz). The fundamental power converter loop operates in hysteretic manner and pumps more energy than required by the system instantaneously. This energy is used until control loop determines the need of more energy.

It would be appreciated by those skilled in the art the output voltage over shoot due to power converter delivering more energy than the load is not an issue as the total power envelope of the system is low in these deep dimming issues. If it is a problem, then the voltage over shoot can be reduced by increasing output capacitor. The key point is deep PWM dimming is achieved without increasing Fsw. Also, traditional analog dimming techniques can be combined with the above technique to achieve even higher dimming ratios.

The PWM-DC can also be smoothly reduced, at a programmable (configurable) rate, based on an event such as thermal de-rating signal. The smooth dimming of PWM-DC eliminates sudden drop in intensity, preserves color point etc. The average LED current can be increased smoothly when LEDs get cooler through PWM-DC as well and thereby eliminating flashing issues. This is possible since average LED currents are reduced through PWM-DC rather than analog dimming. This also preserves color component of the light (assuming LED source color does not shift).

Figure 5:
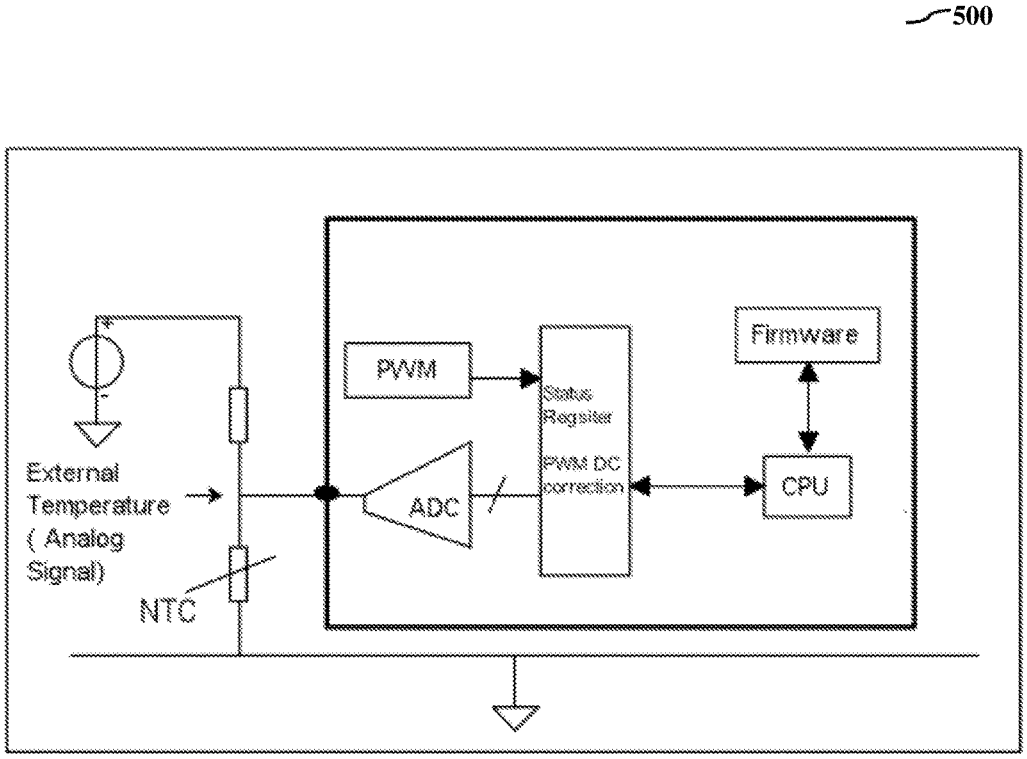
FIG. 5 is an exemplary dimmer circuit to implement temperature color point according to one aspect of the invention.

The controlled increase of PWM-DC results in smooth dimming i.e. eye does not perceive the change. The controlled rate of change in PWM-DC is referred herein as "Smooth PWM Dimming". In high performance backlight display applications, the dimming circuit and method easily accomplish change in PWM-DC to accommodate temperature color point (white point) correction using the dimmer circuit implementation 500 of FIG. 5. Smooth PWM dimming supports applications that require controlled lighting intensity change such as mood lighting, welcome lighting without additional external components.

Also for CCT applications where it is desirable to change light color as a function of dimming intensity, the firmware incorporates instructions for enabling this feature in LED lighting applications which so far has been difficult to achieve. The ease of changing both analog current levels & PWM DC through firmware enables efficient change of light color. The dimmer circuit and method described herein allow for change in light color from say 3000K to 1800K along the black body curve as a function of dimming intensity. The architecture ability to fine tune dimming profile along the black body curve is very useful in lighting applications.

Figure 6:
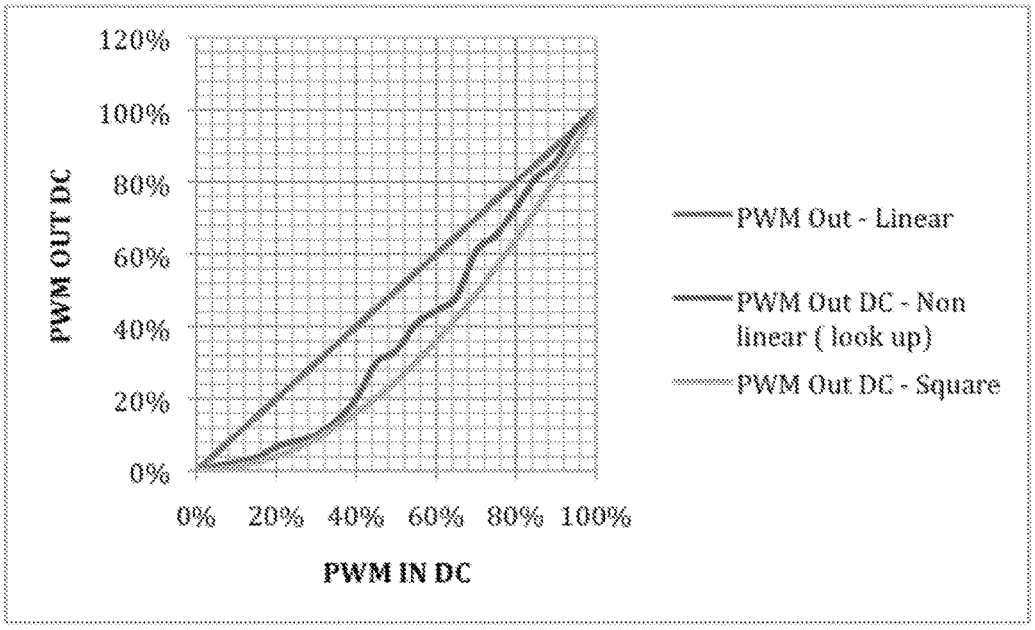
FIG. 6 is a graphical representation showing a linear profile, a non-linear profile and a square wave profile for the dimming output from through the dimmer circuit of the invention.

The dimmer circuit also enables changing PWM DC at a pre-defined rate of change over a pre-defined period of time for achieving a desired dimming profile. In one exemplary implementation the PWM DC change results in linear dimming. In another exemplary implementation the PWM DC change results in non-linear dimming. FIG. 6 is a graphical representation 600 showing linear, non-linear and square wave outputs for PWM DC achieved through the dimmer circuit of the invention, using the inputs as given in the Table 2 below.

TABLE 2

| ## | PWM In DC | PWM Out - Linear | PWM Out DC - Non linear (look up) | PWM Out DC - Square | Factor |
|---|---|---|---|---|---|
| 1 | 0% | 0% | 0% | 0% | 4.00 |
| 2 | 5% | 5% | 1% | 0% | 4.00 |
| 3 | 10% | 10% | 3% | 1% | 4.00 |
| 4 | 15% | 15% | 4% | 2% | 4.00 |
| 5 | 20% | 20% | 7% | 4% | 3.00 |
| 6 | 25% | 25% | 8% | 6% | 3.00 |
| 7 | 30% | 30% | 10% | 9% | 3.00 |
| 8 | 35% | 35% | 14% | 12% | 2.50 |
| 9 | 40% | 40% | 20% | 16% | 2.00 |
| 10 | 45% | 45% | 30% | 20% | 1.50 |
| 11 | 50% | 50% | 33% | 25% | 1.50 |
| 12 | 55% | 55% | 41% | 30% | 1.35 |
| 13 | 60% | 60% | 44% | 36% | 1.35 |
| 14 | 65% | 65% | 48% | 42% | 1.35 |
| 15 | 70% | 70% | 61% | 49% | 1.15 |
| 16 | 75% | 75% | 65% | 56% | 1.15 |
| 17 | 80% | 80% | 73% | 64% | 1.10 |
| 18 | 85% | 85% | 81% | 72% | 1.05 |
| 19 | 90% | 90% | 86% | 81% | 1.05 |
| 20 | 95% | 95% | 95% | 90% | 1.00 |
| 21 | 100% | 100% | 100% | 100% | 1.00 |

The non-linear dimming described herein can be achieved through hardware architecture, or configured through software running on a computer processor. Further the software can be residing inside or outside the chip (chip referred herein is the LED driver system or LED dimmer circuit, also referred as the LED driver architecture, LED driver IC or generally as IC; these terms are interchangeably used) (the exemplary LED driver architecture enables software interface between dimming input and output path) or a combination of both or by using a look up table approach. This approach (non-linear dimming) is useful to implement any dimming profile without sudden jumps or compromise in resolution. Typically, for non-linear piece wise dimming profile, to achieve a clear pattern fit, the resolution has to be high (multiple look up table points leads to higher cost). However, in this approach, the controlled rate of change helps to traverse between points in a gradual manner, there by smoothening the piece wise non-linear approach. This is a big value add to optimize cost and performance of LED lighting applications.

Figure 7:
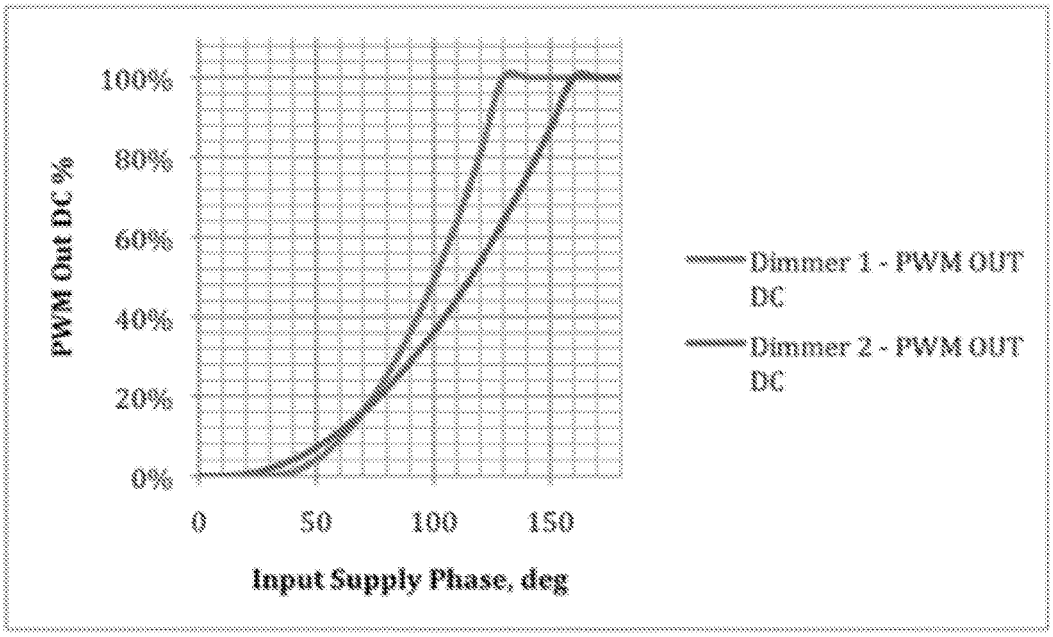
FIG. 7 is the graphical representation of two different dimming outputs achieved through the dimmer circuit of the invention.

In yet another exemplary implementation, the dimmer circuit is configured to translate an external supply phase information to internal PWM DC information, and a min and a max PWM DC point is defined with respect to the external supply phase information. This enables obtaining an adaptable dimming profile, where the PWM DC is changed at a pre-defined profile over a pre-defined period of time (input phase). FIG. 7 shows the graphical representation 700 of two different dimming outputs achieved through the dimmer circuit of the invention based on the Input Supply Phase and External Dimmer 1 Input Supply Phase and External Dimmer 2 Input Supply Phase as illustrated in Table 3 and Table 4 respectively.

TABLE 3

| ## | Input Supply Phase | External Dimmer 1 - Input supply Phase | Dimming condition 1 - PWM IN DC | Dimmer 1 - PWM OUT DC |
|---|---|---|---|---|
| 1 | 0 | 0 | 0% | 0% |
| 2 | 10 | 0 | 0% | 0% |
| 3 | 20 | 0 | 0% | 0% |
| 4 | 30 | 0 | 0% | 0% |
| 5 | 40 | Allowed | 10% | 1% |
| 6 | 50 | Dimmable | 20% | 4% |
| 7 | 60 | Operation | 30% | 9% |
| 8 | 70 | Range | 40% | 16% |
| 9 | 80 | | 50% | 25% |
| 10 | 90 | | 60% | 36% |
| 11 | 100 | | 70% | 49% |
| 12 | 110 | | 80% | 64% |
| 13 | 120 | | 90% | 81% |
| 14 | 130 | | 100% | 100% |
| 15 | 140 | 1 | 100% | 100% |
| 16 | 150 | 1 | 100% | 100% |
| 17 | 160 | 1 | 100% | 100% |
| 18 | 170 | 1 | 100% | 100% |
| 19 | 180 | 1 | 100% | 100% |

The above approach along with the linear or non-linear dimming can alter the dimming profile. This is advantageous over prior art systems and methods, as multiple dimmers can be accommodated with different min/max phase angle point. This provides the adaptable dimming profile requirement.

TABLE 4

| External Dimmer 2 - Input supply Phase | Dimming conition 2 - PWM IN DC | Dimmer 2 - PWM OUT DC |
|---|---|---|
| 0 | 0% | 0% |
| 0 | 0% | 0% |
| Allowed | 7% | 0% |
| Dimmable | 13% | 2% |
| Operation | 20% | 4% |
| Range | 27% | 7% |
| | 33% | 11% |
| | 40% | 16% |
| | 47% | 22% |
| | 53% | 28% |
| | 60% | 36% |
| | 67% | 44% |
| | 73% | 54% |
| | 80% | 64% |
| | 87% | 75% |
| | 93% | 87% |
| | 100% | 100% |
| 1 | 100% | 100% |
| 1 | 100% | 100% |

The dimmer circuit is also configured to distinguish between start up and fault conditions, such as LED short, open conditions. The dimming circuit is further configured to detect output short conditions even on high dimming ratios (very little ON time) without external components. The firmware can also be used to operate power switch (fundamental switch used to energize inductor) as a controlled resistor.

Figure 8:
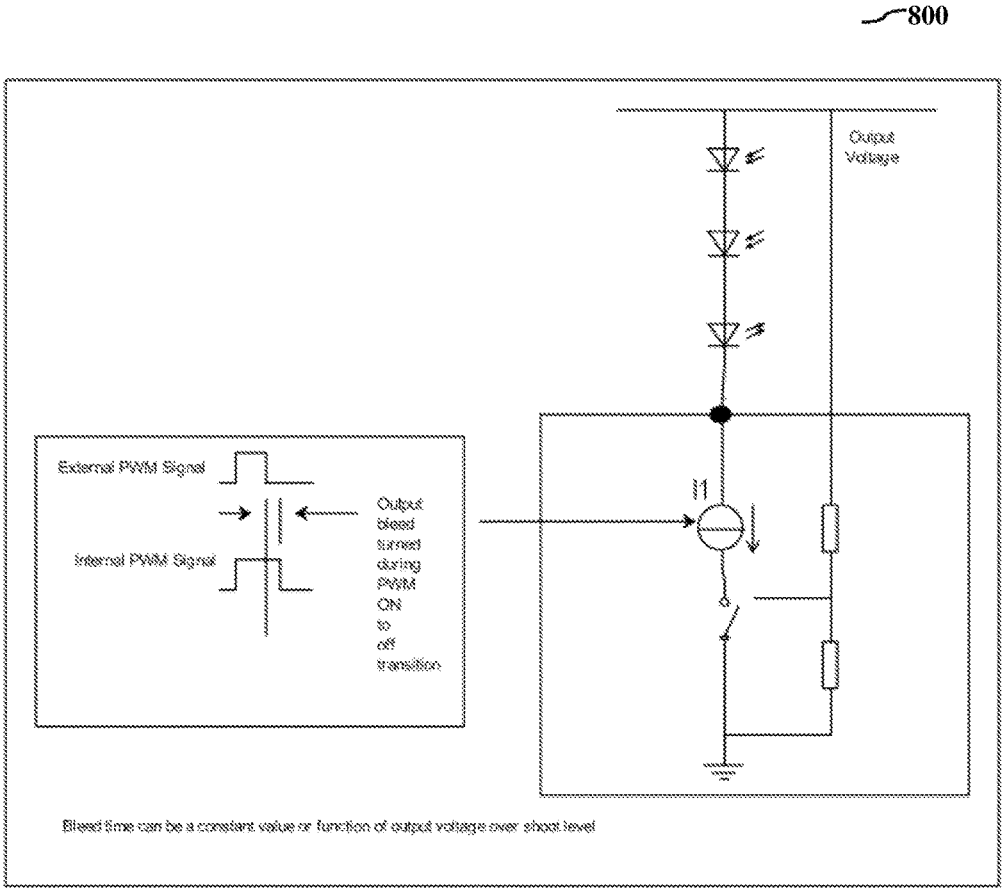
FIG. 8 is a diagrammatic representation for the dimmer circuit of the invention incorporating a controlled current source or a bleeder circuit where the LED current path is turned ON during PWM ON to OFF transition.

Further, a controlled current source or a bleeder circuit incorporated in the dimmer circuit, where the LED current path is turned ON (referred as discharge path) during PWM ON to OFF transition as shown in the representation 800 of FIG. 8. This can be implemented in one of the following approaches:

a. The discharge path is turned ONLY if the output voltage spike level increases beyond a stated level. The discharge path is turned OFF after output voltage reaches safe operating point b. The discharge path can be just turned ON for few PWM cycles after the PWM ON to OFF transition to prevent voltage spike The above approaches may theoretically cause linearity errors at certain high PWM dimming ratios. However, it would be understood by those skilled in the art that at high dimming ratios, the effective output power is low and hence this will not result in huge inductor energy dump in practical implementation. So inherently, in the dimmer circuit and the method of dimming described herein there is a forgiving requirement between high energy levels and high dimming linearity, i.e. high dimming ratios do not translate to high output energy levels. Hence during PWM ON to OFF transition, turning on the discharge path for the LED output for a pre-determined time or at particular output voltage levels prevents the output voltage spike, as well gives an excellent tradeoff between dimming ratios and linearity.

As mentioned earlier, the dimmer circuit for implementing the dimming method has an internal PWM engine. The frequency and phase (duty cycle) of external PWM signal is converted into internal signal while preserving the duty cycle, or changed at a desired profile, of the external signal. The internal PWM engine counter can detect the duty cycle of external analog and digital signal. This is useful in applications, such as Triac dimming, to detect the phase of the dimmer without the need of external circuitry.

In yet another implementation, the PWM DC allows PWM phase splitting of a multi string operation. In the multi string operation, a phase detection is done either based on number of strings of the multi string operation or by using pre-defined instructions in the firmware module. In the multi string operation, an input PWM DC signal can be translated to multiple strings in one of the ways:

(i) All strings have same DC and turn ON and OFF at the same time (No phase splitting)

(ii) All strings have same DC and turn on point is phase shifted. For example, in a four string operation each phase is shifted by (180/4) 45 degrees. The turn off point is correspondingly stretched to maintain identical Duty cycle.

This feature is very useful to reduce system EMI, audio noise effects, reduce output capacitor size.

Another advantage of the system and method described herein is that in hard to specify LED driver interactions with lighting systems, the firmware can be developed on the fly with the LED dimmer circuit of the invention on the lighting application system itself. The dimmer circuit includes auto calibration data to enable on the fly adaption of the adaptable dimming profile. Once the appropriate solution is reached, then the actual chip can be taken to production thus enabling prototype validation prior to production.

The firmware module defines system response and thus the customized solutions can be provided without the expensive and time consuming full IC design and development.

The firmware module can be implemented on an external source such as EEPROM chip, medium, or internally integrated in the driver IC through EEPORM or RAM or through a custom metal mask based ROM. The system described herein thus provides a dedicated low power analog embedded LED driver architecture.

The system described herein also includes a communication interface to read and write contents of the registers that are used to configure system constants and values. The firmware module can be configured through the communication interface. The communication interface can be used to ascertain the condition of LED driver (i.e.) parameters such as LED currents, and the fault warnings of the LED driver IC can be communicated to outside world.

It may be noted here that a power converter is operated in a constant frequency mode and LED currents are defined through a current source architecture in one exemplary implementation. The firmware used to operate a power switch can be at a constant ON time, a constant frequency mode or a variable frequency mode. In another implementation, the LED currents are derived through a resistor approach (Current defined=Voltage/Resistor approach) instead of current source approach.

The LED dimmer circuit described herein is a closed loop system in which the output is powered to the optimal voltage level to ensure LEDs are properly and efficiently driven. The control loop can be implemented in analog or digital domain. In a specific embodiment as described herein the control loop is in digital domain to give greater flexibility in terms of system response, such as programmable non linear gain, varying gain for different application, ease of internal digital compensation, and thereby eliminating the need for complicated analog compensation techniques.

It may be noted that in a multi string architecture, the loop is regulated to longest string and if the longest string encounters a fault such as open LED, or short LED, the firmware module is configured to mark out the faulty string and re-regulates to next longest string. Further, in multi string architecture, each string is observed for potential fault scenarios. On detection of fault, system responds as per the firmware, and the system goes though a low power diagnosis mode. After all faults are detected and accounted, the system resumes the steady state operation. The entire system response is controlled through firmware module. It would be appreciated by those skilled in the art that in multi string architecture, each string can operate at different LED currents and PWM-DC.

Figure 9:
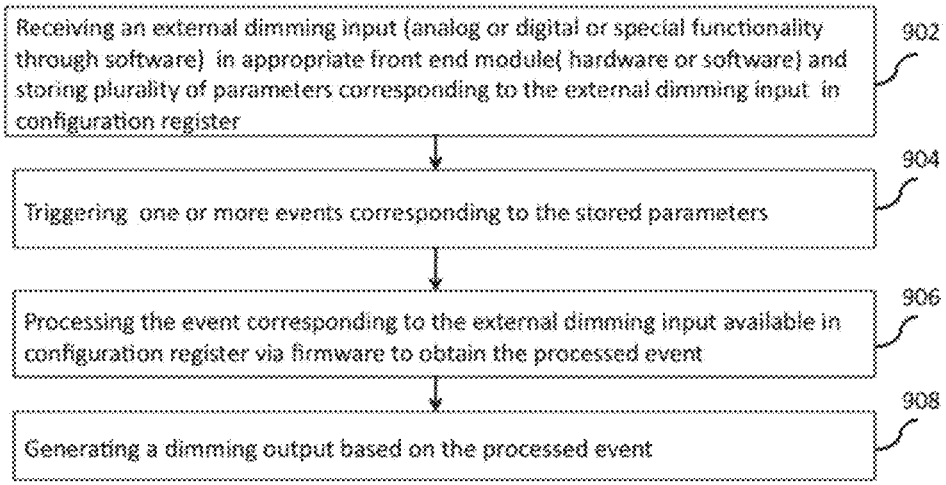
FIG. 9 is a flowchart representation of a method for obtaining a desired dimming profile for a LED lighting application.

In summary, a method for obtaining a desired dimming profile for LED lighting application is disclosed. The method includes steps as shown in FIG. 9. At step 902, the method includes a step for receiving an external dimming input through a front end module (analog module, digital module or software module) and storing a plurality of parameters corresponding to the external dimming input in a configuration register as explained herein above. The basic purpose of the front end module is to derive the parameters such as the dimming duty cycle, frequency information of external dimming input. The method then includes a step 904 for triggering one or more events corresponding to stored parameters. Next at step 906, these one or more events are processed in a prioritized manner based on pre-defined instructions in a firmware module to obtain the processed event, wherein the pre-defined instructions correspond the desired dimming profile. It may be noted here that the processing is done in analog domain, digital domain or software domain based on the predefined instructions. For example, an analog dimming input will be processed though A/D converter, a digital dimming input will be processed by a phase detector of PWM engine, and a software dimming input will be processed through an Interface like SPI. The method then includes the step 908 for generating a dimming output based on the processed event, wherein the dimming output has the desired dimming profile.

The benefits of this system is that the digital module does not have to operate at high speeds and at the same time there is no loss in accuracy of analog signals. The firmware module includes instructions and commands that define how the system should function and results in higher system flexibility and efficiency.

In a specific implementation, as explained hereinabove in addition to analog module, specific digital blocks in the digital module are implemented as per the functionality requirements. The outputs (results) from these digital blocks of the digital module are also treated as events. This technique reduces over all power consumption and pushes the optimal content to digital domain as per the functionality. This results in excellent tradeoff between power, accuracy and functionality.

The external signal or the external dimming input as referred herein can be also be implemented through the software module that defines an event through an interface on an integrated circuit or on a chip incorporating the analog and digital modules.

It may be noted here that in the LED dimmer circuit, all analog signals like external output voltage, feedback signal, temperature, LED currents are all processed by dedicated analog blocks. It may be further noted that the dimming (both pulse width modulation (PWM) and Analog) are implemented in digital domain. The digital processing techniques used to eliminate flicker issues, improve linearity in deep dimming, improve noise immunity from external dimming signal and at the same time does not compromise resolution. In an essence, only blocks that require absolute digital functionality are implemented in digital domain.

The above system and method is advantageous over the available microcontroller based solutions that are expensive in terms of power and additional components (e.g.) microcontroller, power supply for microcontroller and a LED driver that require larger solution space (board space) and system cost.

Yet another advantage of the system described herein is that the system reduces external components (BOM cost), higher functionality and low development time to market and multiple customized products. This is an excellent fit for applications in back lighting, solid state lighting and automotive lighting applications.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. A dimmer circuit for an event based integrated driver system for a light emitting diode (LED) lighting application that uses one or more LEDs, the dimmer circuit comprising:

a front end module configured for receiving an external dimming input in at least one of an analog domain, a digital domain or software domain and for operating a dimming output;

an event generator for generating a plurality of events in a prioritized manner to trigger a respective response through the front end module; and a firmware module configured for storing instructions for processing the plurality of events in the prioritized manner and for processing each response to implement a functionality in the dimming output;

wherein the front end module, the event generator and the firmware module are configured to communicate with each other to generate the dimming output of the one or more LEDs, wherein the dimming output has at least one of a linear profile, a non linear profile, a custom profile or combinations thereof.

2. The dimmer circuit of claim 1 wherein the firmware module comprises an analog module, or a digital module, or a combination thereof.

3. The dimmer circuit of claim 2 wherein the firmware module further comprises a software module.

4. The dimmer circuit of claim 2 wherein the digital module comprises a PWM engine and one or more digital functional components for generating the dimming output.

5. The dimmer circuit of claim 4 wherein the PWM engine comprises a Phase Frequency Detector to detect a phase and a frequency of the external dimming input.

6. The dimmer circuit of claim 4 wherein the PWM engine comprises a Hysteresis component to filter noise on the external dimming input.

7. The dimmer circuit of claim 6 further comprising a power converter that is configured to operate in hysteretic mode when PWM ON time is below a pre-defined value.

8. The dimmer circuit of claim 4 wherein the PWM engine comprises a Smoothening component to control a rate of change of duty cycle for the dimming output.

9. The dimmer circuit of claim 4 wherein the PWM engine comprises a PWM OUT component to generate a duty cycle and frequency of the dimming output.

10. The dimmer circuit of claim 4 wherein the firmware module comprises instructions to turn ON a discharge path for the dimming output during PWM ON to OFF transition.

11. The dimmer circuit of claim 10 wherein the discharge path is turned ON if an output voltage spike level increases beyond a predefined level, and wherein the discharge path is turned OFF after the output voltage reaches a safe operating point.

12. The dimmer circuit of claim 10 wherein the LED discharge path is turned ON for a pre-defined PWM cycles after the PWM ON to OFF transition to prevent an output voltage spike.

13. The dimmer circuit of claim 4 wherein the PWM engine allows PWM phase splitting of a multi string operation based on instructions in the firmware module.

14. The dimmer circuit of claim 13 wherein a phase detection is done either based on number of strings of the multi string operation or by using pre-defined instructions in the firmware module.

15. The dimmer circuit of claim 1 wherein the dimming output is changed at a programmable rate based on instructions in the firmware module.

16. The dimmer circuit of claim 2 wherein the firmware module is configured to distinguish between start up, steady state and fault conditions based on instructions in the firmware module.

17. The dimmer circuit of claim 2 wherein the firmware module comprises instructions to change the dimming output of the one or more LEDs to accommodate temperature color point correction as a function of light intensity for CRI rendering.

18. The dimmer circuit of claim 2 wherein the firmware module comprises instructions for changing a mix of color curve to maintain a true color point across LED temperatures.

19. The dimmer circuit of claim 2 wherein the firmware module is configured to detect an output short condition based on instructions in the firmware module.

20. The dimmer circuit of claim 1 wherein the dimming output is changed at a pre-defined rate of change, over a pre-defined period of time for achieving a desired dimming profile.

21. The dimmer circuit of claim 20 wherein the dimming output change results in linear dimming.

22. The dimmer circuit of claim 20 wherein the dimming output change results in non-linear dimming.

23. The dimmer circuit of claim 1 wherein an external supply phase information is translated to internal information for the dimming output.

24. The dimmer circuit of claim 23 wherein a min and a max point for the dimming output is defined with respect to the external supply phase information.

25. The dimmer circuit of claim 1 wherein an adaptable dimming profile is obtained, wherein the dimming output is changed at a pre-defined profile over a pre-defined period of time.

26. The dimmer circuit of claim 25 further comprises auto calibration data to enable on the fly adaption of the adaptable dimming profile.

27. A method for obtaining a desired dimming profile for LED lighting application, the method comprising:

receiving an external dimming input through a front end module and storing a plurality of parameters corresponding to the external dimming input in a configuration register;

triggering one or more events corresponding to stored parameters;

processing the one or more events based on pre-defined instructions in a firmware module to obtain the processed event, wherein the pre-defined instructions correspond the desired dimming profile; and generating a dimming output based on the processed event, wherein the dimming output has the desired dimming profile.

28. The method of claim 27 wherein the one or more events are prioritized for processing.

29. The method of claim 27 wherein the front end module comprises at least one of analog module, a digital module or a software module, for receiving the external dimming input in an analog domain, digital domain or software domain respectively.

30. The method of claim 29 wherein the processing is done in at least one of analog domain, digital domain or software domain based on the pre-defined instructions.

* * * * *